US007377128B1

(12) United States Patent
Zucker-Pinchoff

(10) Patent No.: US 7,377,128 B1
(45) Date of Patent: May 27, 2008

(54) CLASP FOR ORNAMENTAL MATERIAL

(76) Inventor: Barbara Zucker-Pinchoff, 370 Central Park West Ste. 501, New York, NY (US) 10025

( * ) Notice: Subject to any disclaimer, the term of this patent is extended or adjusted under 35 U.S.C. 154(b) by 0 days.

(21) Appl. No.: 11/243,684

(22) Filed: Oct. 4, 2005

(51) Int. Cl.
*A44C 5/00* (2006.01)

(52) U.S. Cl. ..... 63/3.1; 63/3; 63/42; 24/587.11; 24/587.1; 24/265 EC; 24/265 BC

(58) Field of Classification Search ..... 24/587.11, 24/587.1, 265 EC, 326, 265 BC, 265 US, 24/393; 63/3, 3.1, 42
See application file for complete search history.

(56) References Cited

U.S. PATENT DOCUMENTS 4,246,679 A * 1/1981 Monett ..... 24/587.11
5,367,891 A * 11/1994 Furuyama ..... 63/29.2
5,522,529 A * 6/1996 Yurman et al. ..... 224/176
5,687,585 A * 11/1997 Ferrell ..... 63/21
6,027,213 A * 2/2000 Ignatowski ..... 351/52
6,292,985 B1 * 9/2001 Grunberger ..... 24/303
6,481,065 B2 * 11/2002 Cogdill ..... 24/303
6,505,385 B2 * 1/2003 Grunberger ..... 24/303
6,901,771 B2 * 6/2005 Ooide ..... 63/26
2004/0244419 A1 * 12/2004 Suzuki ..... 63/3.1
2005/0138963 A1 * 6/2005 Williams ..... 63/35

* cited by examiner

*Primary Examiner*—Robert J. Sandy
*Assistant Examiner*—Marcus Menezes
(74) *Attorney, Agent, or Firm*—Brenda Pomerance

(57) ABSTRACT

A clasp for an ornamental material, such as knitwear, has two portions. One end of a clasp portion serves as a mating face, while the other end of a clasp portion has an aperture. The mating faces have complementary registration structures, such as a bump and well, peg and hole, and so on. The apertures receive and conceal the ends of the ornamental material. Thus, a wearable item, such as a necklace, belt, anklet, shawl, sweater, shrug, cape or bracelet, and so on, can be readily formed from knitwear or other ornamental material.

4 Claims, 12 Drawing Sheets

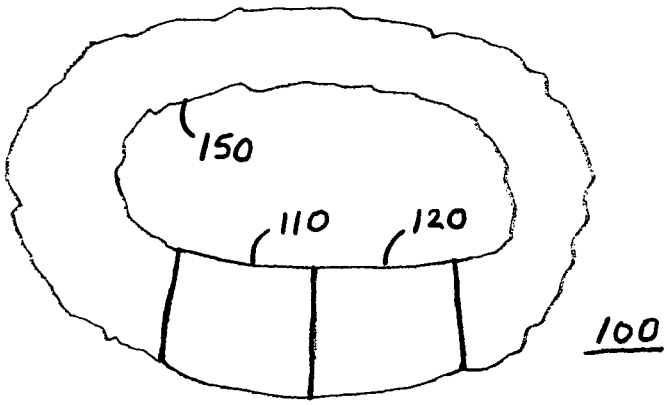
Fig. 3A
Fig. 3B
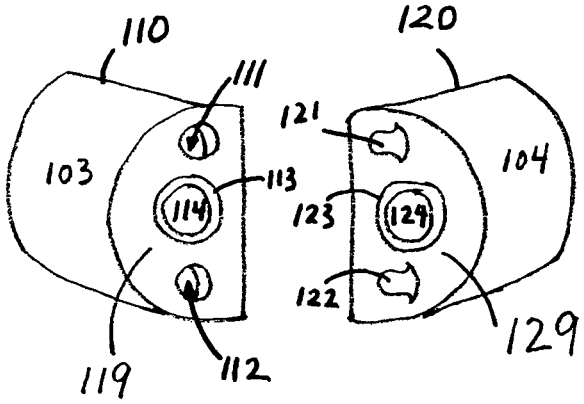
Fig. 3C
Fig. 3D
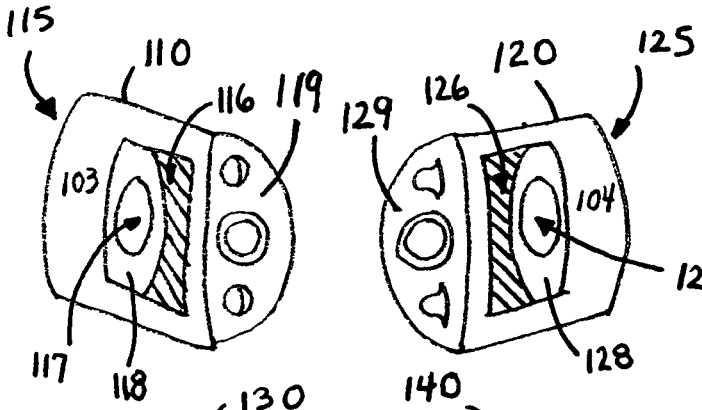
Fig. 3E
Fig. 3F
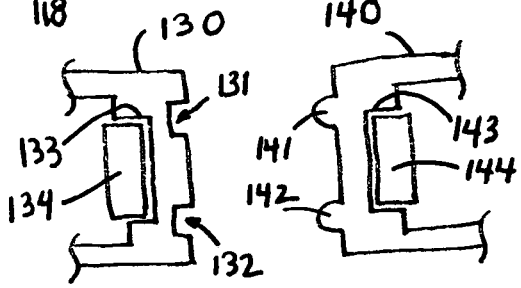
Fig. 3G 101
102
103
104
110
112
114
115
116
117
118
119
120
122
124
125
126
127
128
129

400

500

CLASP FOR ORNAMENTAL MATERIAL

BACKGROUND OF THE INVENTION

The present invention relates to a clasp, and more particularly, is directed to a two-piece connector for ornamental material such as a knitwear necklace.

Necklace clasps are well-known to the jewelry trade. Necklaces are typically made from beads, pearls, gemstones, links, or the like, which are intended to be fully visible. Accordingly, a typical jewelry clasp has loops on the end, and the thread or wire that the beads are strung on is wrapped around the loops.

Recently, specialty yarns have become available so that material knitted from these yarns has sufficient visual appeal to serve as neck, waist and/or wrist ornaments. The ends of the material are usually considered unsightly and to be hidden from view. Thus, conventional jewelry clasps are inappropriate since they do not serve to conceal the ends of the knitted material.

FIG. 1A shows a rectangular piece 90 of knitting or other material, generally 2-3" wide and 14-28" long, for a necklace, has its long sides curled under to form a generally cylindrical shape. Instead of a rectangular piece, the knitwear can alternatively be triangular so as to form a shawl.

As shown in FIG. 1B, clasp 50 is a three piece unit having a main piece adapted to receive connectors 70 and 80 that are connected to the respective short ends of knitwear piece 90. When assembled, clasp 50 provides a smooth receptacle for the ends of piece 90 and completely conceals connectors 70, 80.

Clasp 50 is generally cylindrical with apertures 52, 54 at its short ends. The front of clasp 50 is smooth. The back of clasp 50 has a generally rectangular opening 40, with wall 30 positioned approximately midway along its length. One side of wall 30 has bezel 20 at approximately its midpoint. Bezel 20 contains magnet 10. On the inside back of the main piece of clasp 50, there is located loop 60.

Connector 70 has hook 75 at one of its ends, for engaging with loop 60 of clasp 50. The other end of connector 70 has an aperture for receiving an end of piece 90. As shown in FIG. 1C, the long edges of piece 90 naturally curl under themselves.

Attaching an end of piece 90 to connector 70 is described with reference to FIGS. 1D-1F.

At the aperture end of piece 70, there are holes 71, 72 on opposite sides of the aperture. After an end of piece 90 is inserted into the aperture end of connector 70 (not shown for clarity in understanding the following activity), nail 73 is inserted through holes 71, 72 until nailhead 74 is flush against the outside of connector 70. The portion of nail 73 that protrudes outside hole 72 is cut, and the end of nail 73 is tapped with a riveting hammer so that the metal of nail 73 is formed into a head slightly larger than the circumference of hole 72. In short, the end of piece 90 is held in connector 70 by a rivet formed from nail 73. Nail 73 is formed of the same or a similar material as the main piece of clasp 50, that is, a material appropriate for riveting.

FIG. 1G shows the outside of connector 5, also referred to as endcap 5, which may be employed in place of connector 70 discussed above. FIG. 1H shows the aperture end of connector 5. Openings are made in the sides of connector 5 to form posts 6. As with the connector discussed above, magnet 8 is located in setting 7 in the face of endcap 5 facing its aperture. An end of piece 90 is placed in aperture 5, and then piece 90 is sewn to the connector by making stitches in which the thread passes around the outside of posts 6 and through the material of piece 90.

Connector 80 has protrusion 85 at one of its ends, for engaging with the force from magnet 10 of clasp 50. The other end of connector 80 connects to the end of knitwear 90, in similar fashion as described above for connector 70.

A problem with the knitwear clasp of FIG. 1A is that it is awkward to attach hook 75 to loop 60 while the knitwear necklace is located around the wearer's neck; specifically, the hook requires very careful adjustment so as to be tight enough to stay in place yet loose enough to be easy to disconnect. Another problem is the difficulty of attaching piece 90 to the connectors; if the riveting technique is used, most consumers cannot do this, so a third party must do the riveting. Another problem is that each connector attaches to only one side, resulting in consumer frustration if an incorrect orientation is attempted. Another problem is that consumers misplaced clasp 50, rendering the necklace unwearable. Another problem is that the thickness of the wall of clasp 50, plus the thickness of the wall of endcaps 70 and 80 (or 5), creates a gap or step-off between the material, 90, and the clasp 50, which is visually undesirable. In addition, the thickness of the walls of the endcaps limits the space available for the knitting or other decorative band 90.

FIG. 2A shows another known clasp for knitwear. Knitted piece 96 has its ends coupled to connectors 76, 86, which in turn are held in clasp 56 by magnets. More specifically, as shown in FIG. 2B, connector 76 has nose 79 that holds a magnet. Similarly, connector 86 has nose 89 that holds a magnet. Clasp 56 has apertures 57, 58 for receiving connectors 76, 86, respectively. The back of clasp 56 has openings 46, 47. Walls 36, 37 are located inside clasp 56 and have noses 26, 27 for holding respective magnets that engage with the magnets in the noses of connectors 76, 86 when these connectors are inserted into clasp 56. As shown in FIG. 2C, an end of piece 96 is held in connector 76 using screw 77.

Accordingly, there is room for an improved clasp for knitwear and the like.

SUMMARY OF THE INVENTION

In accordance with an aspect of this invention, there is provided a wearable item, comprising an ornamental material, and a clasp. The clasp has a first portion having a first mating face, and a first aperture for receiving a first end of an ornamental material, and a second portion having a second mating face, and a second aperture for receiving a second end of the ornamental material. The first and second mating faces have complementary registration means.

The wearable item can be a necklace, bracelet, belt, shawl, sweater, shrug, cape or anklet.

According to further aspects of the invention, the first and second portions have respective magnets for coupling the first and second portions to each other. The registration means of the first portion is at least one bump, and the registration means of the second portion is at least one well for receiving the corresponding at least one bump of the first portion. The ornamental material is yarn.

According to still further aspects of the invention, 1 the first portion includes a first wall facing the first aperture, the second portion includes a second wall facing the second aperture, and wherein the first wall and a first end of the ornamental material have first complementary connection means, and the second wall and a second end of the ornamental material have second complementary connection means. In some cases, the first and second complementary connection means comprises a hole in the first wall, a hole in the second wall, and anchors affixed to the first and second ends of the ornamental material. In other cases, the first and second complementary connection means comprises glue on the first wall, glue on the second wall, and wherein the ornamental material is responsive to adhesive action from the glue.

In accordance with another aspect of this invention, there is provided a clasp with a first portion having a first mating face, and a first aperture for receiving a first end of an ornamental material, and a second portion having a second mating face, and a second aperture for receiving a second end of the ornamental material. The first and second mating faces have complementary registration means.

It is not intended that the invention be summarized here in its entirety. Rather, further features, aspects and advantages of the invention are set forth in or are apparent from the following description and drawings.

BRIEF DESCRIPTION OF THE DRAWINGS

FIG. 3A is a front view of necklace 100 formed of ornamental material 150 and clasp portions 110, 120;

FIGS. 3B and 3C are views of the mating faces of clasp portions 110, 120;

FIGS. 3D and 3E are views of the back sides of the clasp portions 110, 120;

FIGS. 3F and 3G are cross-sections of clasp portions 130, 140;

DETAILED DESCRIPTION

A clasp for an ornamental material, such as knitwear, has two portions. One end of a clasp portion serves as a mating face, while the other end of a clasp portion has an aperture. The mating faces have complementary registration structures, such as a bump and well, peg and hole, and so on, which ensure that the two portions fasten to each other without rotation. The apertures receive and conceal the ends of the ornamental material. Thus, a wearable item such as a necklace, belt, anklet, shawl, sweater, shrug, cape or bracelet, and so on, can be readily formed from knitwear or other ornamental material.

FIG. 3A shows necklace 100 formed of ornamental material 150 and clasp portions 110, 120. Clasp portions 110, 120 receive respective ends of ornamental material 150.

Ornamental material 130 is formed of yarn and is generally as a rectangular or triangular piece of knitted material, fabric, leather or one or more strings of beads, pearls, links or gems. As used herein and in the claims, "yarn" refers to any material that can be knitted, crocheted or woven.

Figure 1A:
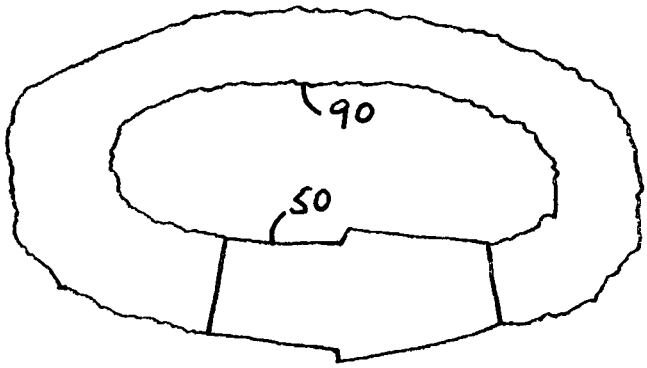
Fig. 1A Prior Art
FIG. 1A is a front view of a known knitwear clasp.
Figure 1B:
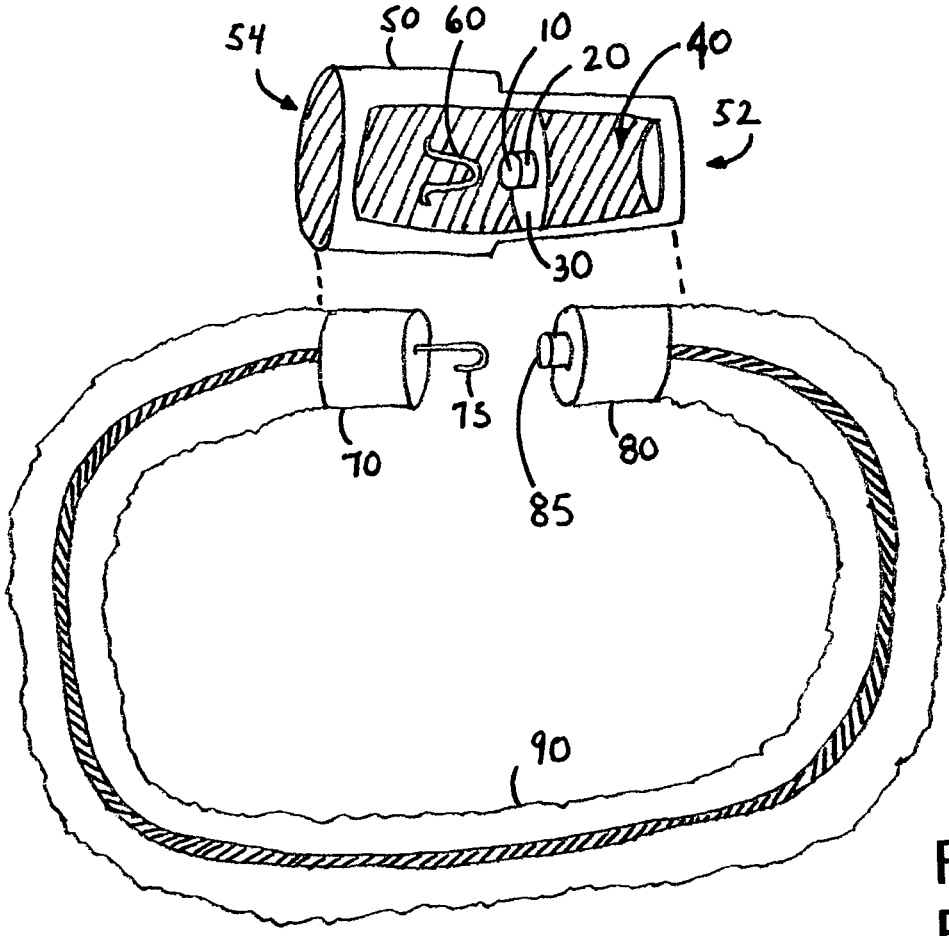
Fig. 1B Prior Art
FIG. 1B is a back view of the clasp of FIG. 1A, also showing the connectors that connect the ends of the knitwear to the clasp.
Figure 1C:
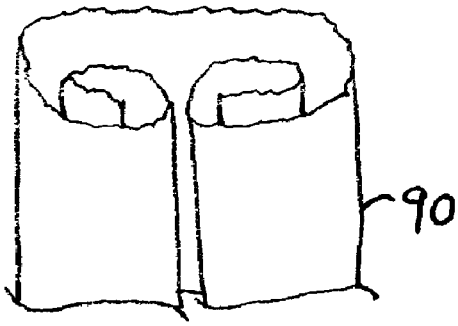
Fig. 1C Prior Art
FIG. 1C is a view of the knitwear used with the clasp of FIG. 1A.
Figure 1D:
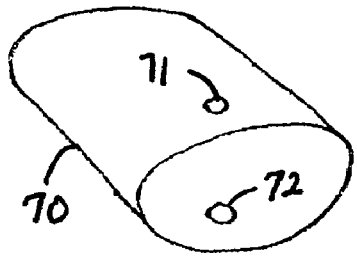
Fig. 1D Prior Art
FIGS. 1D-1F are views showing how the connector of FIG. 1B is connected to the knitwear.
Figure 1G:
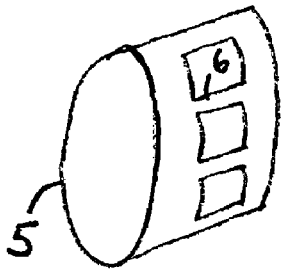
Fig. 1G Prior Art
FIGS. 1G-1H are views of an alternate connector.
Figure 1E:
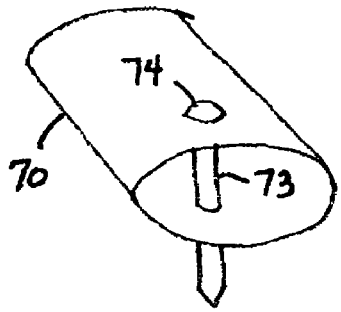
Fig. 1E Prior Art
Figure 1H:
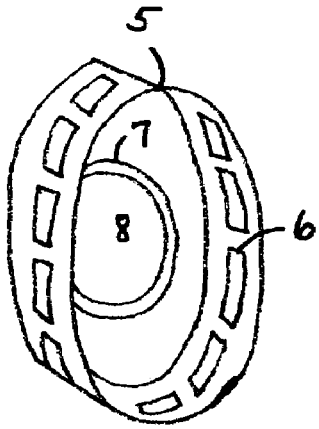
Fig. 1H Prior Art
Figure 1F:
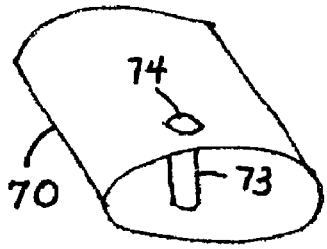
Fig. 1F Prior Art
Figure 2A:
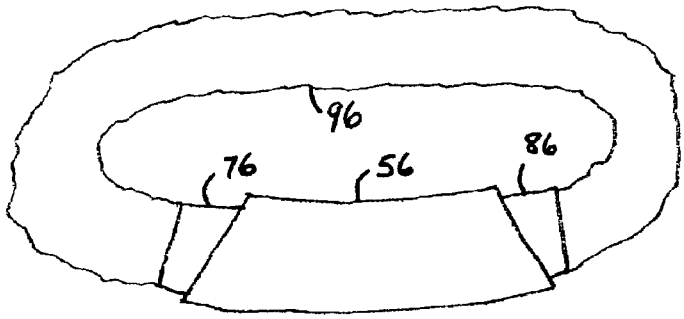
Fig. 2A Prior Art
FIGS. 2A-2C are views of another known knitwear clasp.
Figure 2C:
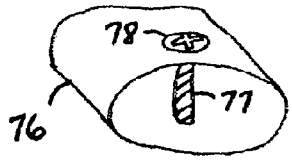
Fig. 2C Prior Art
Figure 2B:
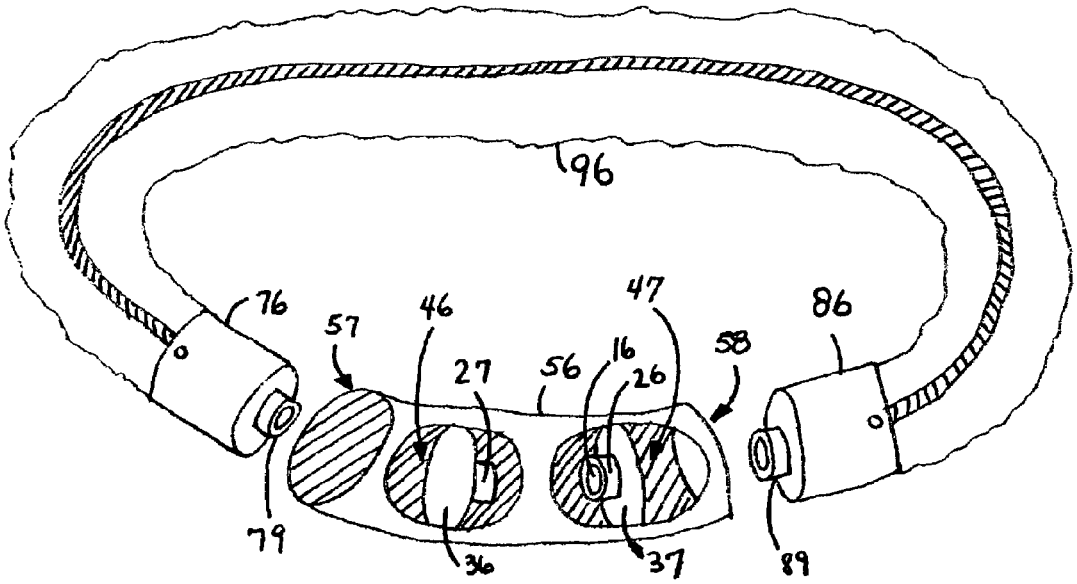
Fig. 2B Prior Art
Figures 3H, 3I:
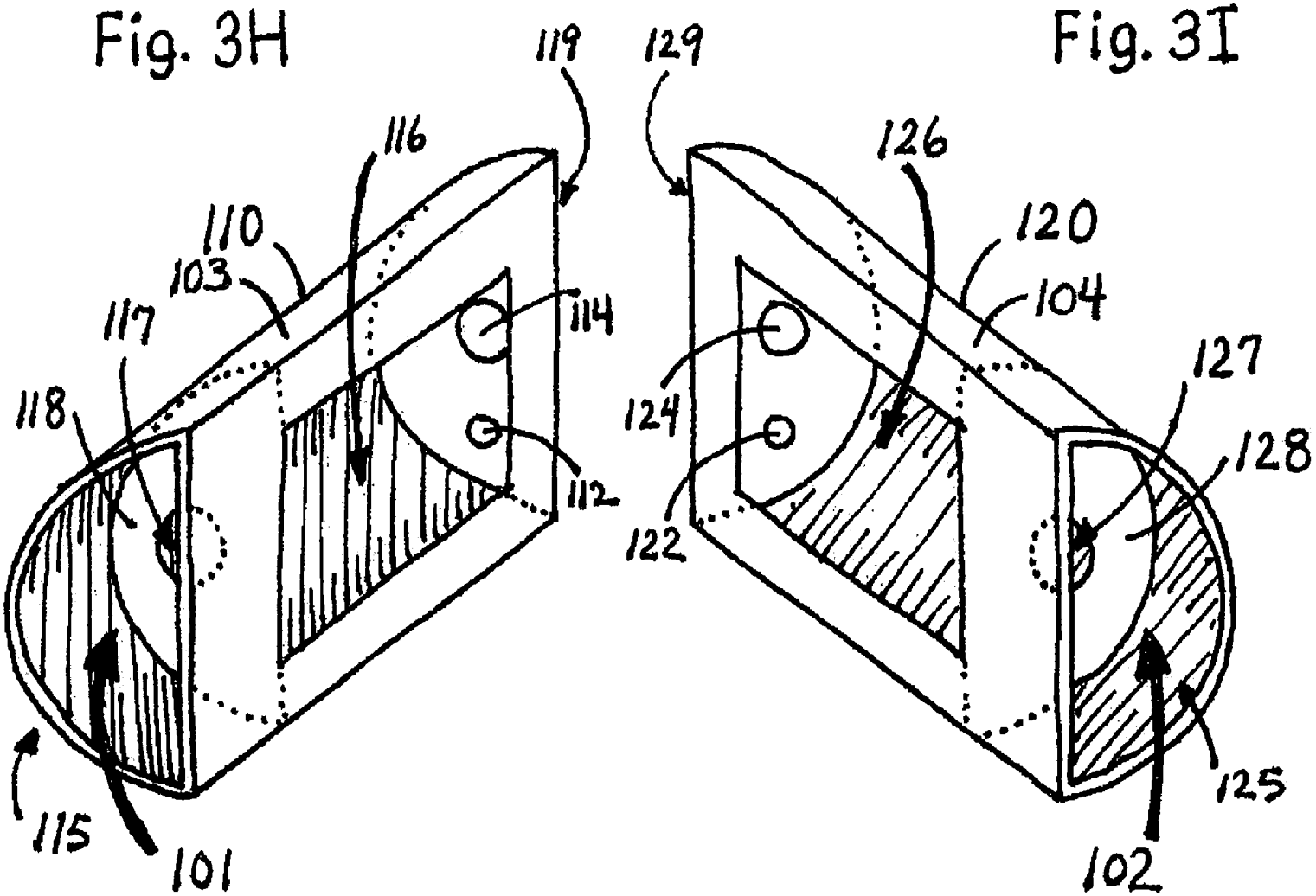
FIGS. 3H and 3I are further views of the back sides of the clasp portions 110, 120.

FIGS. 3B and 3C are views of the mating faces of clasp portions 110, 120. FIGS. 3D and 3E are views of the back sides of the clasp portions 110, 120. FIGS. 3H and 3I are further views of the back sides of the clasp portions 110, 120.

First clasp portion 110 and second clasp portion 120 have apertures 115 and 125 for receiving respective ends of ornamental material 130. Clasp portions 110, 120 form a shape that is generally a tube with a flattened back side, so that the cross-section of the tube has a D-shape. First and second clasp portions 110, 120 have generally the same shape.

First portion 110 has mating face 119. Second portion 120 has mating face 129. In use, mating face 119 and mating face 129 are positioned to face each other, are aligned using registration means, discussed below, and are held together by coupling means, discussed below.

First portion 110 has outer wall 103. Second portion 120 has outer wall 104. Outer walls 103, 104 are respectively connected at one end to mating face 119, 129. The other ends of outer walls 102, 104 respectively define apertures 115, 125.

In this embodiment, registration means comprises wells 111, 112 located in mating face 119, and bumps 121, 122 located in mating face 129. Wells 111, 112 and bumps 121, 122 are complementary registration means. Bumps 121, 122 fit into wells 111, 112 and keep portions 110, 120 aligned.

In a variation, instead of bumps and wells, pegs and holes are used.

Mating face 119 has depression 113, and mating face 129 has depression 123. Magnets 114, 124 are placed in depressions 113, 123 such that when mating faces 119, 129 are adjacent, the magnets exert an attractive force. Magnets 114, 124 are coupling means.

Each of magnets 114, 124 is a permanent magnet, such as a rare earth-neodymium magnet, a rare earth-samarium cobalt magnet, or a sintered neodymium-iron-boron compound. The dimensions and magnetic force of magnets 114, 124 can readily be determined by one of ordinary skill in the art. The strength of the magnets is great enough to securely couple the clasp portions to each other, yet small enough so that the clasp portions can be conveniently separated by a user.

In some embodiments, only one of magnets 114, 124 is provided, and the material of the clasp portion lacking a magnet is formed of a material attracted to a magnet.

In this embodiment, magnets 114, 124 are attached to depressions 113, 123 using glue or other suitable fastening means. However, through the stress of continued use, the magnets may work themselves free of the fastening means, and no longer be positioned in depressions 112, 123.

To avoid this problem, in other embodiments, the faces of the first and second portions are smooth at the center, and the back side of the faces have respective depressions for receiving respective magnets. FIGS. 3F and 3G are cross-sections of clasp portions 130, 140, wherein magnets 134, 144 are located in depressions 133, 143, so that when the first and second portions are coupled the magnets are separated by the material of the walls of the depressions. In these "inverted" embodiments, when the portions of the clasp are pulled apart, the magnets are drawn to their respective depressions, rather than away from them, and so are less likely to work themselves free. Another advantage is that it is easier to glue the magnets in the depressions since they can face each other while the glue dries. A further advantage is that if excess glue is used, the excess does not interfere with the proper alignment of the clasp.

First portion 110 has opening 116 on its backside. Opening 116 is formed by the rear long side of first portion 110, the rear side of mating face 119, and inner wall 118 positioned generally midway between mating face 119 and aperture 115. Inner wall 118 has small hole 117 located midway thereon. Inner wall 118, aperture 115, and a portion of outer wall 103 therebetween form chamber 101. Chamber 101 conceals an end of ornamental material 150.

Second portion 120 has opening 126 on its backside. Opening 126 is formed by the rear long side of second portion 120, the rear side of mating face 129, and inner wall 128 positioned generally midway between mating face 129 and aperture 125. Inner wall 128 has small hole 127 located midway thereon. Inner wall 128, aperture 125 and a portion of outer wall 104 therebetween form chamber 102. Chamber 102 conceals an end of ornamental material 150.

Figure 4A:
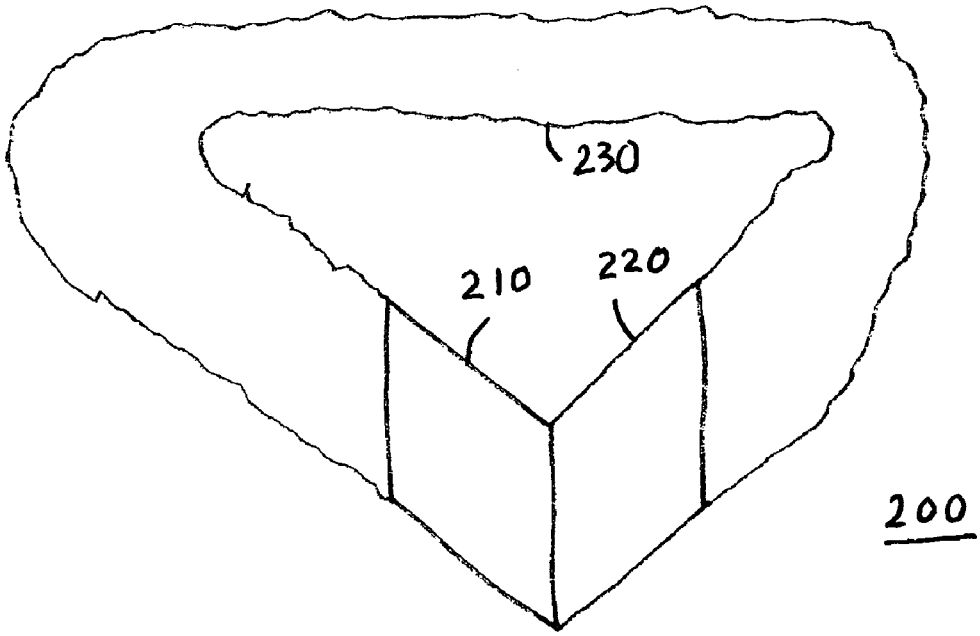
FIG. 4A is a front view of necklace 200 formed of ornamental material 230 and clasp portions 210, 220.
Figure 4B:
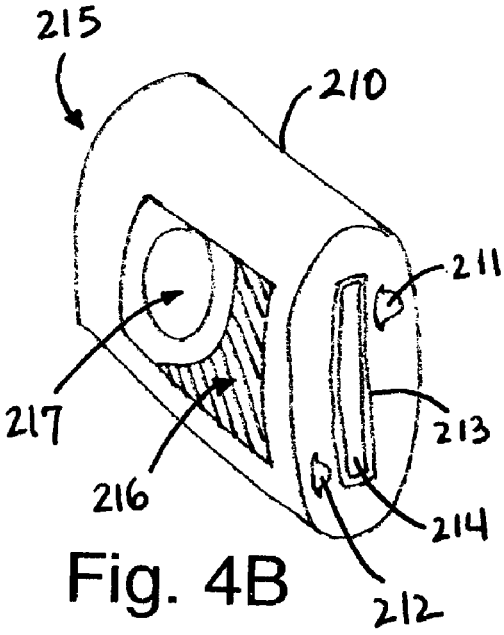
FIGS. 4B and 4C are views of the back sides of the clasp portions 210, 220.
Figure 4C:
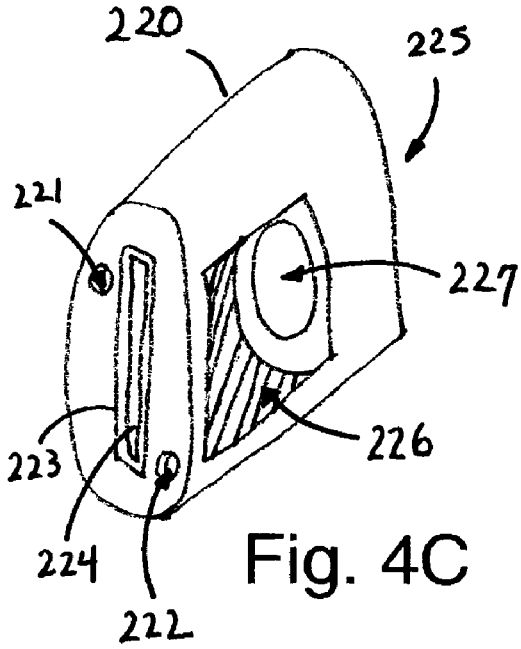

FIG. 4A shows necklace 200 formed of ornamental material 230 and clasp portions 210, 220. FIGS. 4B and 4C are views of the back sides of the clasp portions 210, 220. The clasp portions form a V-shape. Each of portions 210, 220 form the legs of the V-shape. Portions 210, 220 function in similar manner as portions 110, 120, and are not discussed in detail for brevity. Portions 110, 120 have generally the same shape.

Figure 5A:
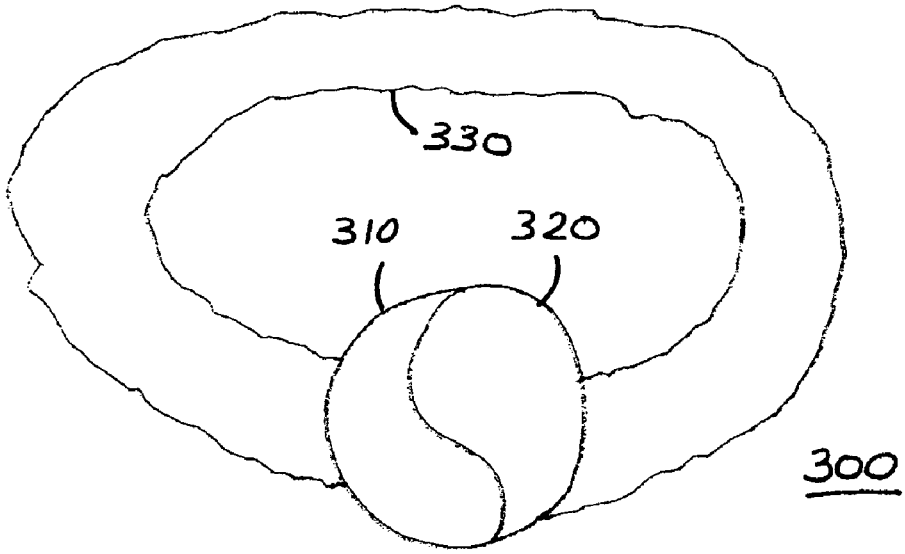
FIG. 5A is a front view of necklace 300 formed of ornamental material 330 and clasp portions 310, 320.
Figure 5B:
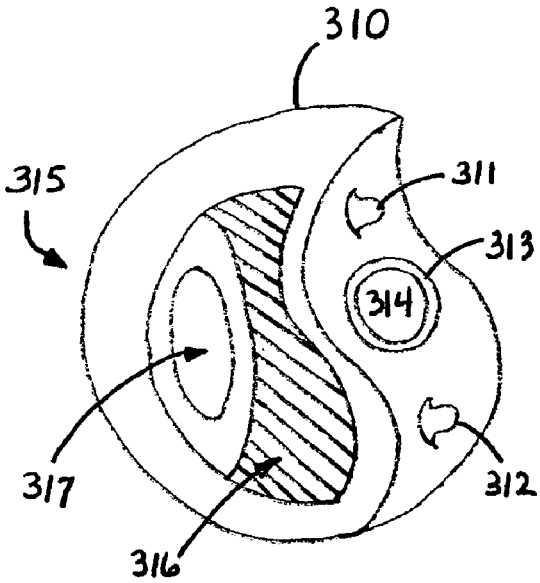
FIGS. 5B and 5C are views of the back sides of the clasp portions 310, 320.
Figure 5C:
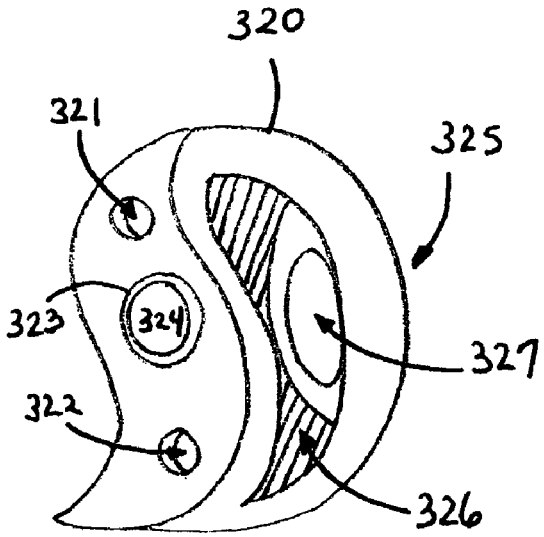

FIG. 5A shows necklace 300 formed of ornamental material 330 and clasp portions 310, 320. FIGS. 5B and 5C are views of the back sides of the clasp portions 310, 320. First and second clasp portions 310, 320 form a shape that is generally a ball with a flattened back, that is, generally semi-spherical. Portions 310, 320 function in similar manner as portions 110, 120, and are not discussed in detail for brevity. Portions 310, 320 have interlocking shapes, that is, the edges of mating faces 319, 329 of portions 310, 320 form a sinuous curve akin to the curve in a yin-yang symbol.

In other embodiments, the clasp has a different overall shape, such as a pyramid, cone, rectangle, pentagon, hexagon, octagon and so on. The clasp is formed of two parts that, in some instances, have generally the same shape, and in other instances, have generally interlocking shapes.

The clasp portions may be fabricated from metal, wood, plastic, rubber, epoxy resin, or other materials having sufficient strength to withstand repeated use. The outer surfaces of the clasp portions may be finished using any suitable technique, such as a polished surface, a brushed surface, and so on. The outer surfaces of the clasp portions may be adorned with raised designs, openings, and/or have ornaments attached such as gems, beads and so on.

The clasp size may be as desired. Generally, a clasp "footprint" of about 1" across is suitable for a bracelet, a clasp footprint of about 2" across is suitable for a necklace, and a clasp footprint of about 3" across is suitable for a belt; however, any size may be used.

Figure 6:
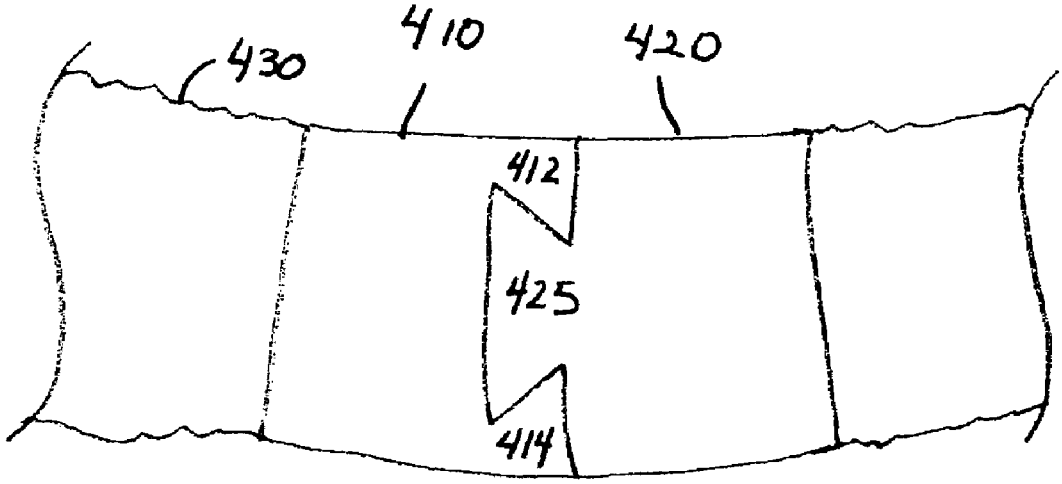
FIG. 6 is a front view of necklace 400 formed of ornamental material 430 and clasp portions 410, 420.

FIG. 6 shows necklace 400 formed of ornamental material 430 and clasp portions 410, 420. Clasp portion 410 has protrusions 412, 414 that form a U-shaped opening, shown here as the bottom of a triangle, for receiving U-shape member 425 of clasp portion 420, shown here as the bottom of a triangle. In use, member 425 slides into the opening formed by protrusions 412, 414, and is thereby mechanically held. Member 425 and protrusions 412, 414 are coupling means and registration means.

In another embodiment (not shown), magnets are located at generally the center of the U-shaped opening and the U-shape member; the attractive force of the magnets that face each other couples the clasp portions even more securely than if only mechanical coupling is relied on.

In other embodiments, other coupling means may be used, such as (i) a snap, (ii) a so-called box clasp wherein one clasp portion has a male shape and the other clasp portion has a female shape that receives and conceals the male shape, (iii) a twist-lock mechanism, wherein one clasp portion has a male shape, and the other clasp portion has a female shape, and in operation, the male shape is inserted into the female shape and twisted to prevent it from falling out, or (iv) other suitable coupling means.

Figure 7:
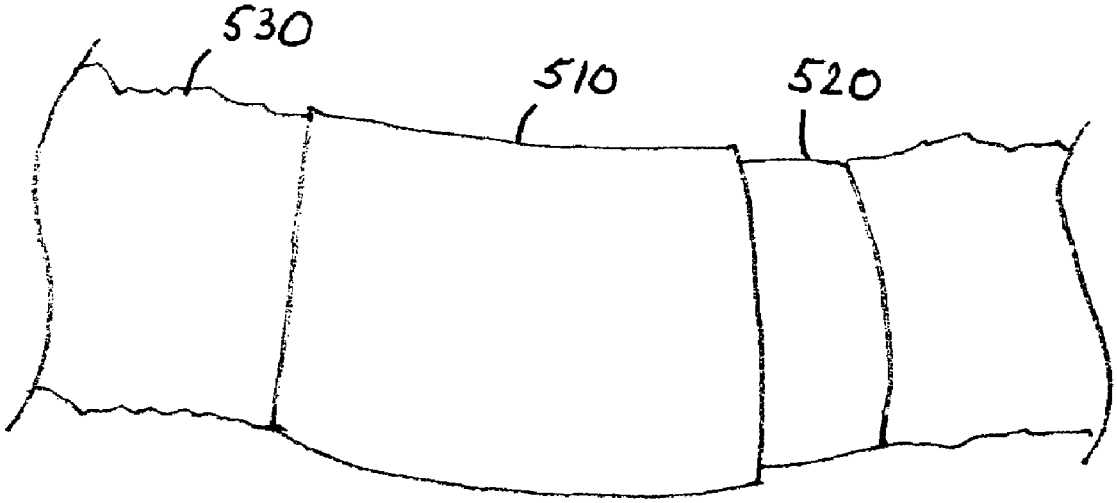
FIG. 7 is a front view of necklace 500 formed of ornamental material 530 and clasp portions 510, 520.

FIG. 7 shows necklace 500 formed of ornamental material 530 and clasp portions 510, 520. Clasp portions 510, 520 are substantially different sizes. In this embodiment, clasp portion 510 has an aperture for receiving clasp portion 520, and registration means and magnetic coupling means as discussed above. Clasp portions 510, 520 each have apertures for receiving the ends of ornamental material 530.

Various techniques for attaching the ornamental material to the clasp will now be discussed.

FIGS. 8A-8D show a technique for preparing the ornamental material to be connected to a clasp.

Figure 8A:
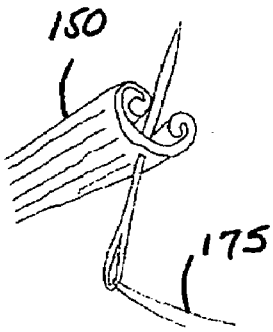
FIGS. 8A-8F are views of a technique for attaching the ornamental material to a clasp portion using glue.
Figure 8B:
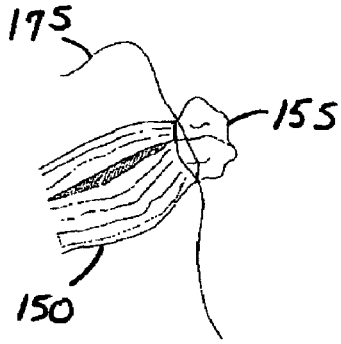
Figure 8C:
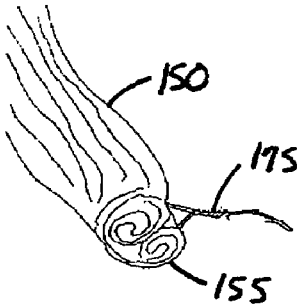
Figure 8D:
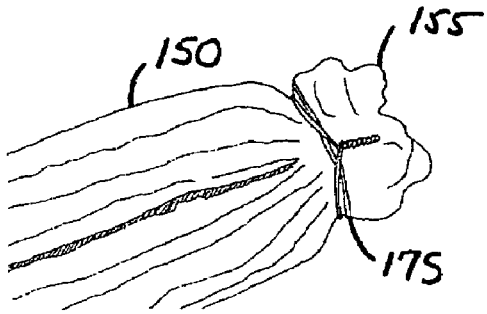

As shown in FIGS. 8A-8B, thread 175 is passed through ornamental material 150 to secure hold its sides together, forming a noose. Thread 175 may be formed of cotton, polyester, wire, or other suitable material. Bunched end 155 refers to the section of material 150 that is next to the noose formed by thread 175. As shown in FIG. 8C, thread 175 is twisted and knotted; if wire is used as thread 175, then the knotting is omitted. The loose ends of thread 175 are clipped, as shown in FIG. 8D.

Figure 8E:
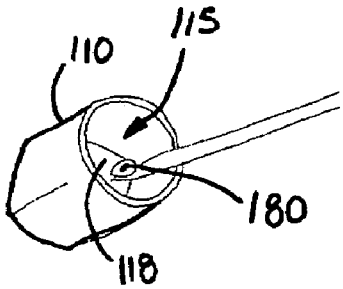
Figure 8F:
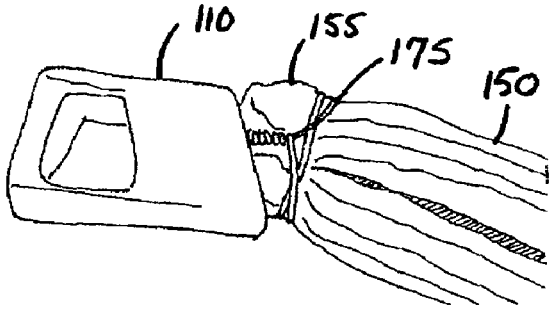

FIGS. 8E-8F shows a technique for attaching the ornamental material to a clasp portion using glue.

As shown in FIG. 8E, glue 180 is placed on wall 118 and on the inside of the cylindrical walls of aperture 115. As shown in FIG. 6F, bunched end 155 of ornamental material 150 is pushed into aperture 115 until bunched end 155 securely contacts the glue.

This procedure is repeated to fasten the other end of ornamental material 150 to second portion 120.

FIGS. 9A-9D shows a technique for attaching the ornamental material to a clasp portion using an anchor.

Anchor 160 is shown as a small button. In other embodiments, anchor 160 is a bead or toggle or other suitable item. The circumference of anchor 160 is small enough to fit into opening 116, but larger than small hole 117. Opening 116 and small hole 117 are shown in FIG. 3D. The square shape of anchor 160 prevents material 150 from twisting.

Figure 9A:
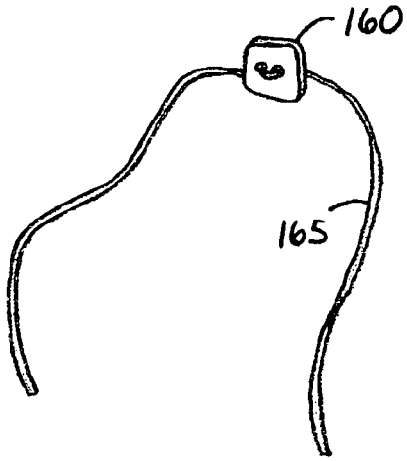
FIGS. 9A-9D are views of a technique for attaching the ornamental material to a clasp portion using an anchor.

As shown in FIG. 9A, thread 165 is passed through holes in anchor 160. Thread 165 may be formed of cotton, polyester, wire, or other suitable material.

Figure 9B:
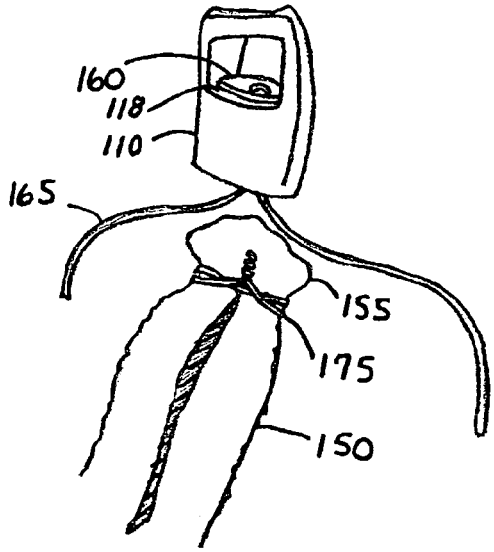

As shown in FIG. 9B, the ends of thread 165 are threaded through small hole 117 and pulled until anchor 160 abuts wall 118. One end of ornamental material 150 is bunched together and secured with thread 175, as discussed above.

Figure 9C:
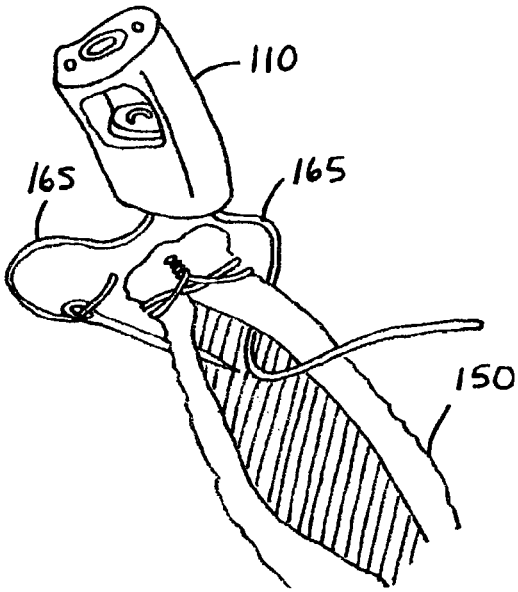

As shown in FIG. 9C, the ends of thread 165 are passed from the outside of ornamental material 150 through to the center, between the rolled edges of ornamental material 150. Bunched end 155 of ornamental material 150 is then pushed into aperture 115, while tightening the ends of thread 165, until the bunched end abuts wall 118.

Figure 9D:
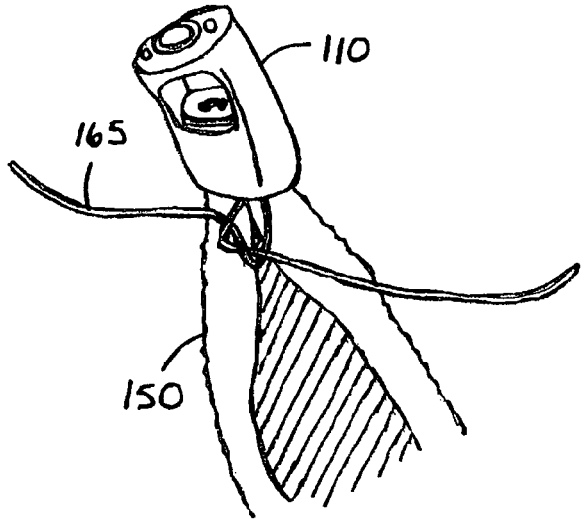

As shown in FIG. 9D, thread 165 is pulled taut and knotted, with the knot being tucked between the rolled edges of ornamental material 150. If thread 165 is formed of wire, then its ends are twisted and tucked, not knotted.

This procedure is repeated, using a separate anchor, to fasten the other end of ornamental material 150 to second portion 120.

Figure 10A:
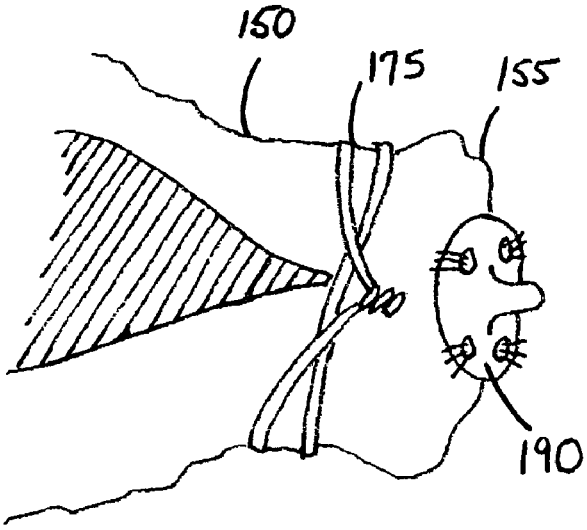
FIGS. 10A-10B are views of a technique for attaching the ornamental material to a clasp portion using a snap.
Figure 10B:
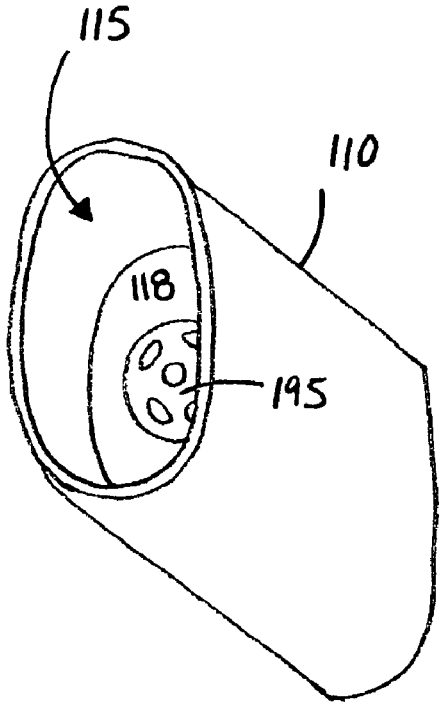

FIGS. 10A-10B shows a technique for attaching the ornamental material to a clasp portion using a snap.

As shown in FIG. 10B, snap portion 195, either the male side or the female side, is glued or otherwise affixed to the side of wall 118 facing aperture 115. In some embodiments, snap portion 195 is cast in place when clasp portion 110 is formed. In other embodiments, snap portion 195 is set in a bezel (not shown) located on wall 118.

As shown in FIG. 10A, one end of ornamental material 150 is bunched together and secured with thread 175. Snap portion 190, the other of the male or female side, is fastened to bunched end 155 of ornamental material 150, such as by sewing or gluing. Bunched end 155 is pushed into aperture 115 until bunched end 155 abuts wall 118 and snap portions 190, 195 mate with each other.

Figure 11A:
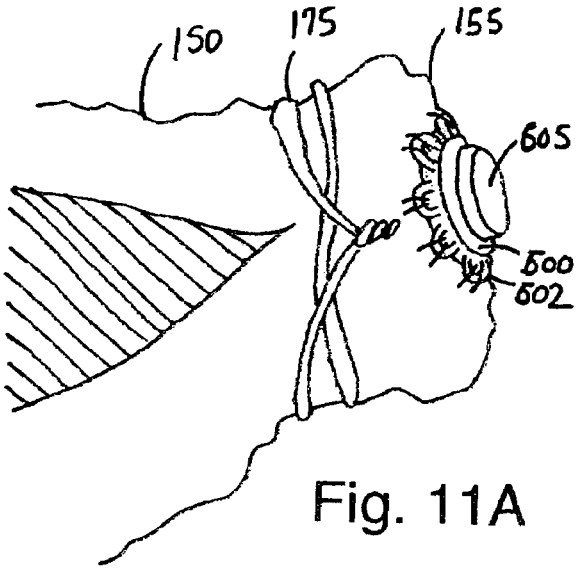
FIGS. 11A-11B are views of a technique for attaching the ornamental material to a clasp portion using magnets.
Figure 11B:
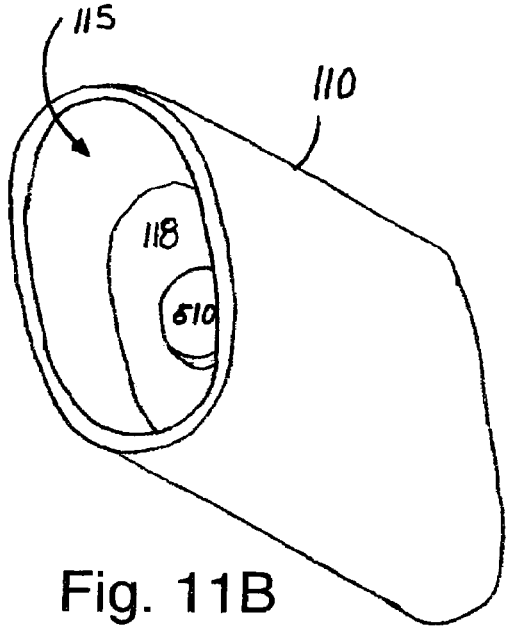

FIGS. 11A-11B are views of a technique for attaching the ornamental material to a clasp portion using magnets.

As shown in FIG. 11B, magnet 610 is glued to the side of wall 118 facing aperture 115.

As shown in FIG. 11A, one end of ornamental material 150 is bunched together and secured with thread 175. Magnet 605 is placed in magnet receptacle 600 having loops 602 around its perimeter, and the loops are sewn to bunched end 155 of ornamental material 150. Bunched end 155 is pushed into aperture 115 until bunched end 155 abuts wall 118 and magnets 605, 610 are in magnetic contact; they may or may not be in physical contact.

Figure 12:
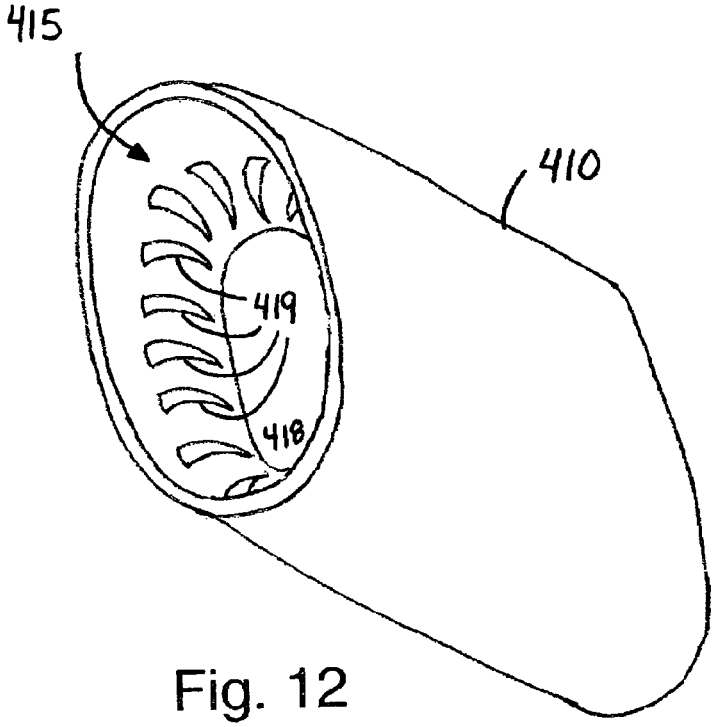
FIG. 12 is a view of a clasp portion having teeth for fastening to the ornamental material.

FIG. 12 shows clasp portion 410 having teeth 419 for fastening to the ornamental material. Teeth 419 have pointed ends directed towards wall 418 of clasp portion 410. In use, one end of ornamental material 150 is bunched together and secured with thread 175, and then bunched end 155 is slid into aperture 415. Bunched end 415 is prevented from sliding out of aperture 415 by teeth 419 that have engaged with the material of bunched end 415.

Although illustrative embodiments of the present invention, and various modifications thereof, have been described in detail herein with reference to the accompanying drawings, it is to be understood that the invention is not limited to these precise embodiments and the described modifications, and that various changes and further modifications may be effected therein by one skilled in the art without departing from the scope or spirit of the invention as defined in the appended claims.

What is claimed is:

1. A clasp, comprising:

a first portion having a first mating face with a first registration means, a first outer wall connected at one end to the first mating face, the first outer wall being generally perpendicular to the first mating face, the other end of the first outer wall forming a first aperture for receiving a first end of an ornamental material, and a first inner wall located inside the first outer wall and generally perpendicular thereto, the first inner wall being between the first aperture and the first mating face, the first inner wall and a first end of the ornamental material having first complementary connection means, the first complementary connection means being a hole in the first inner wall and a first anchor affixed to the first end of the ornamental material, wherein the first aperture, the first inner wall and a portion of the first outer wall therebetween form a first chamber for concealing the first end of the ornamental material, and a second portion having a second mating face with a second registration means, a second outer wall connected at one end to the second mating face, the second outer wall being generally perpendicular to the second mating face, the other end of the second outer wall forming a second aperture for receiving a second end of the ornamental material, and a second inner wall located inside the second outer wall and generally perpendicular thereto, the second inner wall being between the second aperture and the second mating face, the second inner wall and a second end of the ornamental material having second complementary connection means, the second complementary connection means being a hole in the second inner wall and a second anchor affixed to the second end of the ornamental material, wherein the second aperture, the second inner wall and a portion of the second outer wall therebetween form a second chamber for concealing the second end of the ornamental material, wherein the first and second registration means are complementary to each other and are for fastening the first and second portions to each other.

2. A clasp, comprising:

a first portion having a first mating face with a first registration means, a first outer wall connected at one end to the first mating face, the first outer wall being generally perpendicular to the first mating face, the other end of the first outer wall forming a first aperture for receiving a first end of an ornamental material, and a first inner wall located inside the first outer wall and generally perpendicular thereto, the first inner wall being between the first aperture and the first mating face, the first inner wall and a first end of the ornamental material having first complementary connection means, the first complementary connection means being glue causing the first inner wall to adhere to a first end of the ornamental material, wherein the first aperture, the first inner wall and a portion of the first outer wall therebetween form a first chamber for concealing the first end of the ornamental material, and a second portion having a second mating face with a second registration means, a second outer wall connected at one end to the second mating face, the second outer wall being generally perpendicular to the second mating face, the other end of the second outer wall forming a second aperture for receiving a second end of the ornamental material, and a second inner wall located inside the second outer wall and generally perpendicular thereto, the second inner wall being between the second aperture and the second mating face, the second inner wall and a second end of the ornamental material having second complementary connection means, the second complementary connection means being glue causing the second inner wall to adhere to the second end of the ornamental material, wherein the second aperture, the second inner wall and a portion of the second outer wall therebetween form a second chamber for concealing the second end of the ornamental material, wherein the first and second registration means are complementary to each other and are for fastening the first and second portions to each other.

3. A wearable item, comprising:

an ornamental material having a first end and a second end, and a clasp having a first portion having a first mating face with a first registration means, a first outer wall connected at one end to the first mating face, the first outer wall being generally perpendicular to the first mating face, the other end of the first outer wall forming a first aperture for receiving a first end of the ornamental material, and a first inner wall located inside the first outer wall and generally perpendicular thereto, the first inner wall being between the first aperture and the first mating face, the first inner wall and a first end of the ornamental material having first complementary connection means, the first complementary connection means being a hole in the first inner wall and a first anchor affixed to the first end of the ornamental material, wherein the first aperture, the first inner wall and a portion of the first outer wall therebetween form a first chamber for concealing the first end of the ornamental material, and a second portion having a second mating face with a second registration means, a second outer wall connected at one end to the second mating face, the second outer wall being generally perpendicular to the second mating face, the other end of the second outer wall forming a second aperture for receiving a second end of the ornamental material, and a second inner wall located inside the second outer wall and generally perpendicular thereto, the second inner wall being between the second aperture and the second mating face, the second inner wall and a second end of the ornamental material having second complementary connection means, the second complementary connection means being a hole in the second inner wall and a second anchor affixed to the second end of the ornamental material, wherein the second aperture, the second inner wall and a portion of the second outer wall therebetween form a second chamber for concealing the second end of the ornamental material, wherein the first and second registration means are complementary to each other and are for fastening the first and second portions to each other.

4. A wearable item, comprising:

an ornamental material having a first end and a second end, and a clasp having a first portion having a first mating face with a first registration means, a first outer wall connected at one end to the first mating face, the first outer wall being generally perpendicular to the first mating face, the other end of the first outer wall forming a first aperture for receiving a first end of an ornamental material, and a first inner wall located inside the first outer wall and generally perpendicular thereto, the first inner wall being between the first aperture and the first mating face, the first inner wall and a first end of the ornamental material having first complementary connection means, the first complementary connection means being glue causing the first inner wall to adhere to a first end of the ornamental material, wherein the first aperture, the first inner wall and a portion of the first outer wall therebetween form a first chamber for concealing the first end of the ornamental material, and a second portion having a second mating face with a second registration means, a second outer wall connected at one end to the second mating face, the second outer wall being generally perpendicular to the second mating face, the other end of the second outer wall forming a second aperture for receiving a second end of the ornamental material, and a second inner wall located inside the second outer wall and generally perpendicular thereto, the second inner wall being between the second aperture and the second mating face, the second inner wall and a second end of the ornamental material having second complementary connection means, the second complementary connection means being glue causing the second inner wall to adhere to the second end of the ornamental material, wherein the second aperture, the second inner wall and a portion of the second outer wall therebetween form a second chamber for concealing the second end of the ornamental material, wherein the first and second registration means are complementary to each other and are for fastening the first and second portions to each other.

* * * * *